United States Patent [19]

Ziegenfuss, Jr.

[11] Patent Number: 5,004,296

[45] Date of Patent: Apr. 2, 1991

[54] FLOATING LOUNGE CHAIR

[76] Inventor: James N. Ziegenfuss, Jr., 2525 Apt. 6 Royal Palm Ave., Ft. Myers, Fla. 33901

[21] Appl. No.: 388,521

[22] Filed: Aug. 2, 1989

[51] Int. Cl.[5] ..... A47C 7/62

[52] U.S. Cl. ..... 297/194; 441/132; 297/456

[58] Field of Search ..... 441/126, 127, 129, 130, 441/132; 297/455, 456, 192, 194, 188, DIG. 1, DIG. 7

[56] References Cited

U.S. PATENT DOCUMENTS

| | | | |
|---|---|---|---|
| 1,002,701 | 9/1911 | Kasztriner | 441/126 X |
| 3,117,327 | 1/1964 | Mathew . | |
| 3,471,875 | 10/1969 | Lyon | 441/130 |
| 3,740,095 | 6/1973 | Nail | 441/130 X |
| 4,115,888 | 9/1978 | Sievers | 441/132 X |
| 4,484,781 | 11/1984 | Phelps | 297/456 X |
| 4,564,240 | 1/1986 | Thieme . | |
| 4,662,852 | 5/1987 | Schneider et al. . | |

FOREIGN PATENT DOCUMENTS

| | | | |
|---|---|---|---|
| 19051 | of 1895 | United Kingdom | 441/126 |

*Primary Examiner*—Laurie K. Cranmer

[57] ABSTRACT

A floating lounge chair that can also be used on land. A relatively light weight rigid panel acts as a base for an elongated air cushion, such that the person can be fully supported in a reclining position on the cushion. A U-shaped rigid plastic foam arm rest is attached to the rigid panel. Various recesses are formed in the plastic foam material to hold various items, e.g. a beverage glass, portable radio, book, etc.

3 Claims, 1 Drawing Sheet

FLOATING LOUNGE CHAIR

BACKGROUND AND SUMMARY OF THE INVENTION

Various floating lounge chairs have been developed for use in swimming pools, on lakes, etc. U.S. Pat. No. 3,117,327 to D. Mathew shows one floating lounge chair. Other floating lounge chair constructions are shown in U.S. Pat. No. 4,564,240 to G. Thieme and U.S. Pat. No. 4,662,852 to S. Schneider.

The present invention relates to a lounge chair that can be used on water or on land. The chair is designed to have a relatively large trapped air volume, hence relatively good buoyancy for supporting a relatively heavy person (when used on water). Compartments are built into the chair for containment of such items as a battery-operated radio, unopened cans of beer or pop, and a beverage glass. A person using the chair can relax, while enjoying the radio and having ready access to beverages located on the chair. The chair preferably includes a full length air-inflated cushion structure that extends from the person's shoulder area to his/her foot area; the person is thus fully supported in a semi-prone position in the chair.

THE DRAWINGS

DESCRIPTION OF A PREFERRED EMBODIMENT OF THE INVENTION

Figure 1:
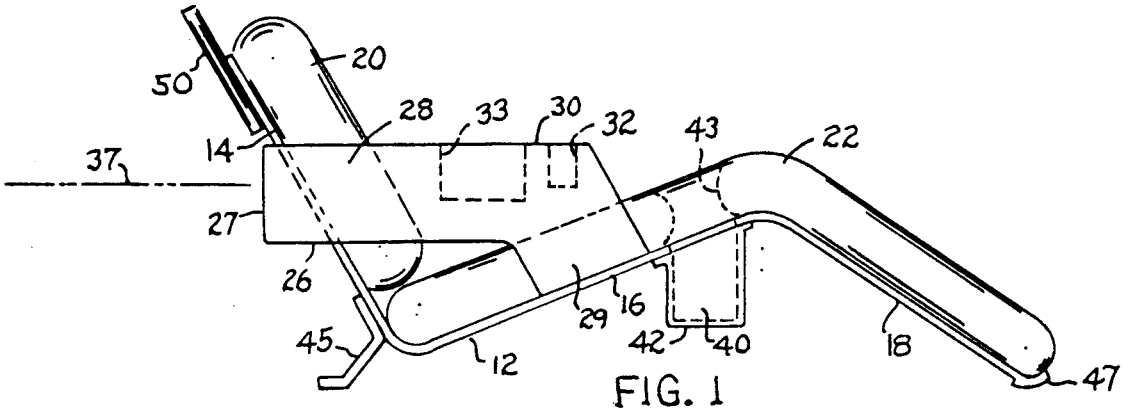
FIG. 1 is a side elevational view of a lounge chair embodying the invention.
Figure 2:
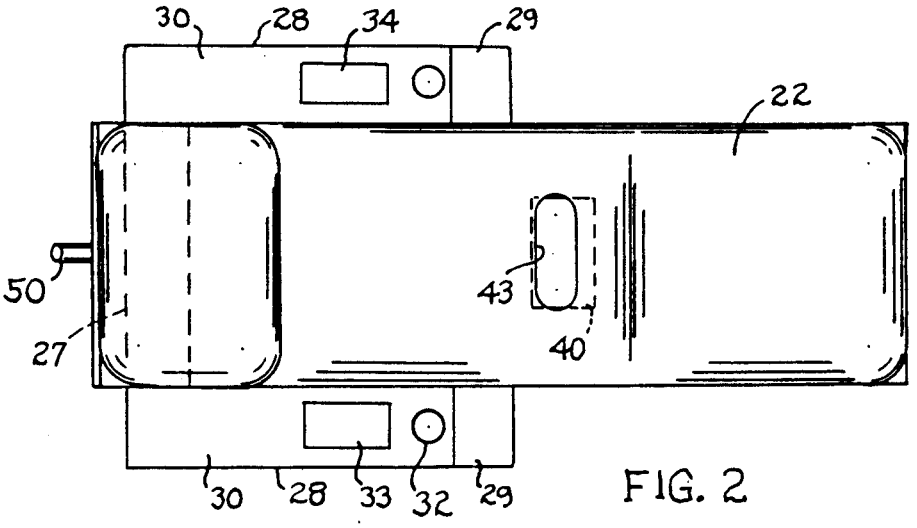
FIG. 2 is a top plan view of the chair shown in FIG. 1.

FIGS. 1 and 2 show a chair 10 adapted to support a person in a semi-prone position while the chair is floating in water. The chair includes air chambers that provide buoyant support for the chair and chair occupant. Near its rear-end the chair has a downwardly-extending leg structure that provides support for the chair when it is positioned on a land surface, e.g. floor of a room, outdoor patio, etc. The chair can be used on land or water without adjustment or structural change.

The chair main frame (shell) is comprised of a rigid light-weight panel 12 having an S-shaped configuration, as seen in side elevation (FIG. 1). Panel 12 will be formed of a light weight rigid structural plastic material; holes will be formed through the plastic material at regularly spaced intervals, so as to reduce the weight of the panel.

Panel 12 includes an upwardly-extending section 14 adapted to support the persons back area. An intermediate section 16 of the panel extends upwardly and forwardly from the lower end of section 14 to form a support surface for the person's buttocks and upper leg areas. A front section 18 of the panel angles downwardly from intermediate section 16 to form a support surface for the person's lower leg areas.

The person does not sit directly on right panel 12. Rather, he or she sits (reclines) on two hollow air-inflated cushions 20 and 22. These cushions are formed of thin gage plastic sheets having their peripheral edges sealably connected together to form buoyant air chambers. The lower faces of cushions 20 and 22 are adhesively attached to upper surface areas of rigid panel 12. It would be possible to use one single air-inflated cushion in place of the two cushions 20 and 22. However, the use of two cushions is advantageous in that the cushions then undergo minimum distortion when they are fastened to panel 12. Each cushion is initially formed as a flat hollow panel a few inches thick. The cushions cover substantially the entire upper surface area of panel 12.

The chair includes a U-shaped member 26 formed of a closed cell rigid plastic foam material. Member 26 includes a thickened web portion 27 extending transversely along the rear surface of back support portion 14 of S-shaped panel 12. Two vertically thickened arm portions 28 extend forwardly from web portion 27. The front sections of arm portions 28 extend downwardly, as at 29, to contact outboard surface areas of panel 12; the panel extends laterally outwardly where it contacts sections 29 of the foam member 26. The foam member can be adhesively attached to panel 12 along the rear surface of back support portion 14 and at contacted points along panel section 16.

The upper face 30 of each arm portion 28 has sufficient size to support a person's lower arm. At least one cavity is formed in each face 30 for containment of miscellaneous articles. As shown in FIG. 2, there are three cavities, numbered 32, 33 and 34 in the two arm portions 28. Cavity 33 forms a receptacle for containing a battery-operated radio. Cavity 32 forms a receptacle for containing a beverage glass, e.g. iced tea, soda pop, beer, etc. Cavity 34 forms a receptacle for other items, e.g. a book, sunglasses, sun lotion, comb, sandwiches, etc.

The buoyant members 20, 22 and 27 are sized and oriented so that when the chair is occupied and in the water the upper faces 30 of arm rest portions 28 will be approximately level (horizontal). Typically the water level will be some distance below faces 30, e.g. on reference line 37.

The chair is preferably designed to include a compartment for storing a number of unopened cans containing pop or beer. As shown in FIG. 1, a compartment (tray) 40 extends downwardly from the intermediate section 16 of rigid panel 12. The compartment will be large enough to store a few cans of beer or pop, typically six cans. Bottom wall 42 of compartment 40 will be parallel to faces 30 of arm portions 28 so that when the chair is floating in the water (occupied) the beverage cans will stand upright in the compartment. Cushion 22 is formed with an opening 43 therethrough for enabling the seat occupant to reach into compartment 40 to remove a beverage can. Opening 43 can be somewhat smaller in size than the plan dimension of compartment 40. Normally the person's upper leg areas will overlie access opening 43. However, the person can readily move his/her leg when necessary to gain access to compartment 40. Chopped ice (cubes) can be poured into compartment 40 to keep the canned beverages cool. The walls of compartment 40 are preferably solid (non-porous).

The illustrated chair is designed primarily for use in the water. However, it can also be used out of the water. A leg structure 45 is attached to panel 12 at the lower end of back-support portion 14. The chair is adapted to be supported with leg structure 45 and foot end 47 of the chair resting on the land surface.

The chair can include provision for supporting an umbrella, e.g. when the person is reclining in an outdoor pool under a hot sun. A socket 50 can be attached to portion 14 of the seat to support an umbrella, not shown.

The drawings necessarily show a specific form of the invention. It will be understood that the invention can be practiced in various ways, as contemplated by the appended claims.

I claim:

1. A chair adapted to support a person in an semi-prone position while the chair is floating in the water, comprising:

a rigid concave shell structure that includes an S-shaped panel having two reverse curves therein for defining an upwardly-inclined rear section adapted to support a person's back area, an intermediate section adapted to support a person's buttocks and upper leg areas, and a declining front section adapted to support a person's lower leg areas;

said shell structure further including two arm rest panels attached along opposite side edges of the intermediate section of said S-shaped panel; each arm rest panel being formed of a closed cell rigid plastic foam material; each arm rest panel having an upper face insert B1 that has sufficient size to support a person's lower arm, and at least one cavity formed in said upper face for containment of a beverage container;

air-inflated cushion means secured to the S-shaped panel for cushionably supporting a person in the chair; said cushion means extending along substantially the entire length of said S-shaped panel to form a support surface for a person's back, buttocks and leg areas; rigid leg means (45) extending downwardly from said concave shell structure at the rear section thereof, whereby the chair is adapted to support a person out of the water with said leg means and said front section of the panel resting on the land surface; and an upwardly-opening compartment means (40) extending downwardly from the intermediate section of said panel for containment of a number of canned beverages within reach of a person seated in the chair.

2. The chair of claim 1, wherein said compartment means comprises a bottom wall (42) extending generally parallel to the upper faces of the arm rest panels.

3. The chair of claim 1, wherein said cushion means has an opening (43) therethrough aligned with said compartment means, whereby a person seated in the chair can reach through said opening to remove a beverage can from the compartment means.

* * * * *